United States Patent [19]

Défago et al.

[11] 4,137,042

[45] Jan. 30, 1979

[54] DRY HEAT PROCESS FOR DYEING AND PRINTING ORGANIC MATERIAL WHICH CAN BE DYED WITH CATIONIC DYES

[75] Inventors: Raymond Défago, Riehen; Stefan Koller, Ramlinsburg; Peter Moser, Binningen, all of Switzerland

[73] Assignee: Ciba-Geigy AG, Basel, Switzerland

[21] Appl. No.: 576,193

[22] Filed: May 8, 1975

[30] Foreign Application Priority Data

May 20, 1974 [CH] Switzerland ..... 6884/74
Feb. 13, 1975 [CH] Switzerland ..... 1787/75

[51] Int. Cl.[2] ..... D06P 5/00

[52] U.S. Cl. ..... 8/2.5 A; 8/1 W; 8/4; 8/41 A; 8/168 A; 8/168 AA; 106/22

[58] Field of Search ..... 8/2.5, 2.5 A, 1 W, 41 A, 8/168 A, 168 AA; 106/22

[56] References Cited

U.S. PATENT DOCUMENTS

| | | | |
|---|---|---|---|
| 2,755,200 | 7/1956 | Balon et al. | 117/36 |
| 3,346,322 | 10/1967 | Finkenauer | 8/93 |
| 3,347,865 | 10/1967 | Brack et al. | 260/313.1 |
| 3,399,191 | 8/1968 | Brack | 260/240.6 |
| 4,040,779 | 8/1977 | Loew et al. | 8/2.5 A |
| 4,087,241 | 5/1978 | Psaar | 8/2.5 A |

FOREIGN PATENT DOCUMENTS

| | | |
|---|---|---|
| 815109 | 11/1974 | Belgium. |
| 2325308 | 11/1973 | Fed. Rep. of Germany. |
| 2359515 | 6/1974 | Fed. Rep. of Germany. |
| 2521988 | 12/1975 | Fed. Rep. of Germany. |
| 7009621 | 4/1970 | Japan. |
| 6917952 | 6/1970 | Netherlands. |
| 1342304 | 1/1974 | United Kingdom. |

OTHER PUBLICATIONS

Ayyangar, N. R. and Tilak, B. D., "Basic Dyes", in Venkataraman's "*The Chemistry of Synthetic Dyes*", vol. IV (Academic Press), 1971, pp. 103–160.

Lubs, H. A., "The Chemistry of Synthetic Dyes and Pigments" (American Chemical Society; Hafner), 1965, pp. 272–274.

*Primary Examiner*—A. Lionel Clingman

*Attorney, Agent, or Firm*—Wenderoth, Lind & Ponack

[57] ABSTRACT

A dry heat process for dyeing and printing and optically brightening organic material which can be dyed with cationic dyes, which process comprises the use of electroneutral, deprotonized cationic dyes or fluorescent brighteners together with at least one indicator dye.

12 Claims, No Drawings

DRY HEAT PROCESS FOR DYEING AND PRINTING ORGANIC MATERIAL WHICH CAN BE DYED WITH CATIONIC DYES

The present invention provides a dry heat process for dyeing and printing organic material which can be dyed with cationic dyes, especially synthetic fibrous material made from polyacrylonitrile and modacryl, the dyeing preparations and carriers suitable therefor as well as the organic material which is dyed and printed by the novel process.

Transfer printing processes are known which consist on dyeing and printing synthetic fibres, especially polyester fibres, but also polyacrylonitrile fibres, at temperatures of c. 190° to 220° C. over the course of 10 to 60 seconds, with disperse dyes which are converted into the vapour state at atmospheric pressure and at temperatures between 150° and 220° C. In this dry heat transfer of disperse dyes from an inert carrier, e.g. paper, to textiles, better colour yields in conjunction with improved fastness properties of the resultant dyeings are obtained with higher temperatures and a longer heat treatment. However, when using polyacrylonitrile fibres, a distinct and undesirable hardening of the fibres usually occurs under transfer conditions which are advantageous for disperse dyes, i.e. depending on the duration of action at temperatures of 190° C. and above. In addition, the dyeings and prints obtained with disperse dyes do not have the brilliance that is usually obtained on such materials with cationic. dyes. However, at temperatures of 120° C. and 190° C., and, at very short action times, of up to 210° C., i.e. under conditions that cause virtually no damage to the polyacrylonitrile fibres, disperse dyes yield only dyeings which are faint, partly of poor fastness, especially of poor fastness to rubbing, and therefore useless.

For dyeing polyacrylonitrile fibres by conventional aqueous methods, the ordinary commercially available cationic dyes are used principally in the form of their salts with strong inorganic acids, for example as chlorides, bromides, methane sulphates or zinc chloride double salts. The vapour pressures of these ordinary, commercially available dye salts are very low at temperatures below 200° C. at atmospheric pressure. Unless steam and moist textile material are used, they produce therefore on polyacrylonitrile fibres faint dyeings or no dyeings at all in the dry transfer printing process at temperatures of 150° to 210° C.

German Offenlegungsschrift 2,325,308 describes the use of cationic dyes together with oxidants and Belgian Patent 808,059 the use of salts of cationic dyes with acids having a $pK_s$ value greater than 3 for producing strong and fast dyeings and prints by dry heat processes, especially on synthetic fibrous material of acid-modified polyacrylonitrile. Both these processes require a double reaction which takes place advantageously in situ direct on the carrier or by the action of dry heat during the heat transfer process. Moreover, strong electrolyte salts are formed which can have detrimental effects.

Swiss Patent Application No. 6884/74 describes a process which makes it possible, in simple manner and avoiding the difficulties and disadvantages mentioned hereinbefore, to effect on organic material that can be dyed with cationic dyes, especially synthetic fibrous material of acid-modified polyacrylonitrile, dyeings and prints which are dry, strong and fast, in particular fast to light. This dry, heat process consists in using electroneutral, deprotonised cationic dyes or fluorescent brighteners, advantageously in finely divided form, for dyeing, printing and brightening, and wherein the surprising observation was made that these novel, deprotonised cationic dyes or fluorescent brighteners used according to the invention can be transferred without decomposing and produce strong and fast dyeings and prints on organic material which can be dyed with cationic dyes. In comparison to the known cationic dye salts, the deprotonised cationic dyes have in addition the great advantage that they can be applied in salt-free form and usually in the form of dispersions to the carriers necessary for the heat transfer process. In contradistinction to solutions, dispersions fill in the micro-roughnesses on paper — which is advantageous — and also dispersion particles do not penetrate so deeply into the transfer paper as happens with dissolved dyes, so that the transfer yield is thereby increased.

However, this process has the drawback that the deprotonised cationic dyes have to a large extent a different shade from the salt form of these compounds or else are colourless. The consequences are:

When printing multicoloured designs, these can assume an entirely different character on the carrier through pronounced shades receding and background shades becoming dominant. When this occurs, the printer is no longer able to adjust roller pressure, speed, and other variables in connection with printing to an optimum production of the print.

The recognition of printing errors (blade streaks, distortions, too fat or too meagre a print) during the printing procedure is very greatly hindered with such temporarily occuring pale shades and quite impossible if a very light or even colourless print results.

It is not readily possible to establish serious errors in the colour preparation or entirely possible mistakes in colour (red instead of blue, for example). Only a subsequent transfer print on the textile material, when the original colour reappears, makes a sampling possible and this is expensive and time-consuming.

It has now been found that it is possible to avoid in simple manner these disadvantages of the cited novel process by using the deprotonised cationic dyes together with at least one indicator dye, advantageously in amounts of 0.1 to 10 and especially 0.5 to 1.5 percent by weight, based on the amount of dye employed.

The invention therefore provides a dry heat transfer printing process for dyeing or printing organic material which can be dyed with cationic dyes, especially synthetic fibrous material made from acid-modified polyacrylonitrile, which process comprises the use of deprotonised cationic dyes, advantageously in finely divided form, together with indicator dyes. The indicator dye should desirably not effect any acid reaction, since otherwise the deprotonised compounds might be converted into the salt form beforehand and not, as desired, only on the printing substrate.

According to the invention, it is desirable to use electroneutral, deprotonised cationic dyes or fluorescent brighteners whose chromophoric systems are derived from cationic methine, azomethine, azo, hydrazone, enamine, oxazine, thiazine, triphenylmethane and diazine dyes and whose cationic character is derived from a carbonium or ammonium group, or fluorescent brighteners whose chromophoric system contain heterocyclic-aromatic rings with tertiary nitrogen atoms and which form salts under the acid conditions normally necessary for their application, e.g. benzimidazole derivatives.

Particularly suitable deprotonised cationic dyes are those of the formula I

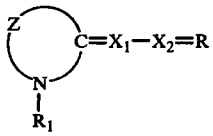

(I)

wherein R is an aromatic, a heterocyclic or an aliphatic radical which contains a deprotonised nitrogen atom (=N—), each of $X_1$ and $X_2$ independently is N, CH or $CR_2$, wherein $R_2$ is alkyl of 1 to 4 carbon atoms, aryl or aralkyl, Z is a divalent radical which optionally contains further heteroatoms or fused rings and which completes the nitrogen-containing ring to form an unsaturated 5- or 6-membered ring, and $R_1$ is unsubstituted or substituted alkyl, and the deprotonised nitrogen atom in R is conjugation to the

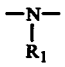

group, irrespective of the lenght of the conjugation system which advantageously extends over 3 to 17 members.

R in the significance of an aromatic, a heterocyclic or an aliphatic radical which contains a deprotonised nitrogen atom is, for example, the N-phenylquinonimine, N-ethylquinonimine, N-phenylquinondiimine, 1,3,3,4-tetrahydro-2,2,4-trimethylquinoline, pyrrole, indole, aniline or alkylamine radical, the latter advantageously containing 4 to 10 carbon atoms. The aromatic and heterocyclic radicals can contain the customary substituents for cationic dyes, e.g. halogen, especially chlorine, lower alkyl, especially methyl or ethyl, lower alkoxy, especially methoxy or ethoxy, or the nitro group.

The group

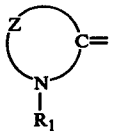

(I)

in which Z is a divalent radical which optionally contains further heteroatoms or fused rings and which completes the nitrogen-containing ring to form an unsaturated 5- or 6-membered ring, is e.g. the pyrrole, pyrazole, thiazole, triazole, benzthiazole, indole, pyridine or quinoline radical.

$R_1$ in the significance of an unsubstituted or a substituted alkyl radical is e.g. the methyl, ethyl, cyanoethyl, chloroethyl, carbamoylethyl, benzyl, chlorobenzyl, methylbenzyl or phenethyl group.

The deprotonised cationic dyes and fluorescent brighteners used according to the invention are electroneutral. They are obtained by treating cationic dyes which contain a proton at one nitrogen atom which is in resonance to a quaternary nitrogen atom with strong bases, such as alkali hydroxides, in particular sodium methylate, in aqueous, aqueous-organic or organic solution, and isolating the resultant deprotonised cationic dye, e.g. by filtration, and drying it. They can be manufactured in this way e.g. from the cationic dyes cited in the following patents: Japanese Patent No. 74 04031, British Patent No. 1,345,662, DOS Nos. 2,234,468 and 2,222,628, DAS No. 1,664,243, Japanese Patents Nos. 74 04287, 74 04530 and 74 04531.

Particular mention is to be made of the triphenylmethane dye of the formula

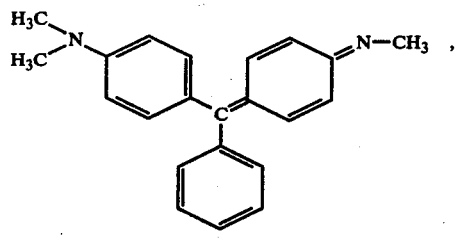

the oxazine dye of the formula

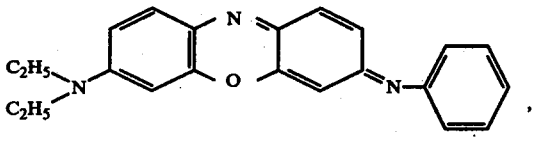

the fluorescent brightener of the formula

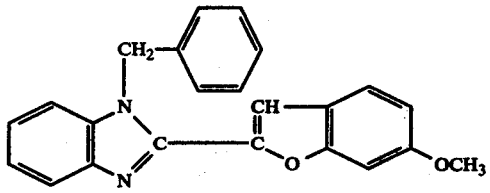

and also the dyes of the formulae 2 to 5 which fall under formula I

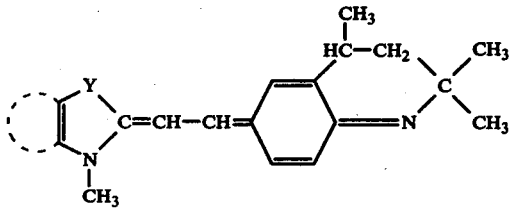

(2)

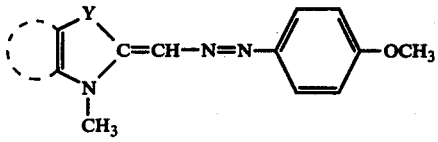

(3)

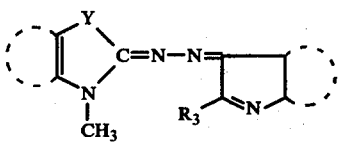

(4)

$R_3$= alkyl$_{C_1-C_4}$, phenyl

-continued

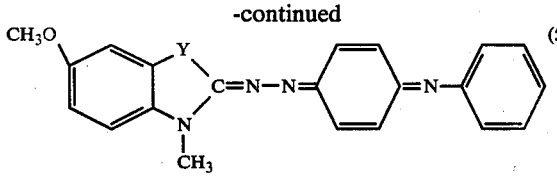

(5)

in which formulae Y is $$-CH_2-,\ -C(R_{C_1-C_4})_2-,\ -NR_{C_1-C_4}-\ \text{or}\ -S-$$

The indicator dyes to be used according to the invention can belong to the most diverse classes. For example, they can be disperse dyes, pigment dyes, vat dyes or reactive dyes. Dyes with acid reaction are not advantageous.

It is advantageous to use those indicator dyes or dyestuff mixtures as defined herein which have the same shade as that of the deprotonised cationic dyes after conversion into their salt form and which do not themselves transfer into the textile material.

It is particularly advantageous to use as indicator dye the salt form of the protonised dyes which correspond to the deprotonised cationic dyes. It is desirable to use the indicator dye in amounts of 0.5 to 1.5 percent by weight, based on the amount of the deprotonised dye.

Examples of organic materials which can be dyed with cationic dyestuffs, and which can be dyed and/or treated with fluorescent brighteners according to the present invention, are: tannin:-treated cotton, leather, wool, polyamides, such as polyhexamethylenediamine adipate, poly-ε-caprolactam or poly-ω-aminoundecanoic acid, polyesters, such as polyethylene glycol terephthalate or polycylohexane-dimethylene terephthalate, but above all acid-modified synthetic fibres, especially acid-modified polyamides, e.g. polycondensation products of 4,4'-diamino-2,2'-diphenyldisulphonic acid or 4,4'-diamino-2,2'-diphenylalkanedisulphonic acids with polyamide forming starting materials, polycondensation products of mono-aminocarboxylic acids or their amide forming derivatives or of dibasic carboxylic acids and diamines with aromatic dicarboxysulphonic acids, e.g. polycondensation products of ε-caprolactam or hexamethylenediammonium adipate with potassium-3,5-dicarboxybenzenesulphonate, or acid-modified polyester fibres, such as polycondensation products of aromatic polycarboxylic acids, for example terephthalic or isophthalic acid, polyhydric alcohols, e.g. ethylene glycol, and 1,2- or 1,3-dihydroxy-3-(3-sodium sulphopropoxy)-propane, 2,3-dimethylol-1-(3-sodium sulphopropoxy)-butane, 2,2-bis-(3-sodium sulphopropoxyphenyl)-propane or 3,5-dicarboxybenzenesulphonic acid or sulphonated terephthalic acid, sulphonated 4-methoxy-benzenecarboxylic acid or sulphonated diphenyl-4,4'-dicarboxylic acid. Preferred, however, are polyacrylonitrile fibres (containing at least 85% acrylonitrile) and modacryl fibres. In the polymerisation of acrylonitrile and comonomers, persulphate radicals (deriving from the usual catalyst systems) consisting of potassium persulphate, potassium metasulphite and ferriammonium sulphate, are built into the chain ends as regulators. In addition to acrylonitrile, other vinyl compounds are normally used as comonomers, e.g. vinylidene chloride, vinylidene cyanide, vinyl chloride, methacrylic amide, vinyl pyridine, methylvinyl, pyridine, N-vinylpyrrolidone, vinyl acetate, vinyl alcohol, methylmethacrylate, styrenesulphonic acid or vinylsulphonic acid.

Provided the devices suitable for the purpose are available, the fibre material dyed or treated with fluorescent brighteners according to the invention can be any in desired form, for example in the form of flocks, slubbing, yarn, texturised fibres, woven fabrics, knitted fabrics, non-wovens from fibres, ribbons, webs, textile floor coverings, such as woven needle felt carpets or hanks of yarn which can be in the form of webs or are cut or ready finished, but also in the form of sheets. The fibre material can also be in the form of fibre blends or blended fabrics.

The process according to the invention can be carried out, for example, in the following way: Printing inks which contain at least one finely divided, electroneutral, deprotonised cationic dye together with an indicator dye, optionally a binder which is stable below 230° C., water and/or an organic solvent, are applied to an inert carrier and dried, then the treated side of the carrier is brought into contact with the surface of the organic material to be dyed, carrier and material are subjected, optionally under mechanical pressure, to a heat treatment of 120° to 210° C., advantageously 170° to 190° C., over the course of 5 to 60 seconds, and the dyed material is then separated from the carrier.

The inert intermediate or auxiliary carrier required for the dry heat transfer, i.e. a carrier for which the electroneutral, deprotonised cationic dyes used according to the invention have no affinity, is advantageously a flexible, preferably three-dimensionally stable sheet material, such as a ribbon, strip, or a foil with appropriately smooth surface, which is stable to heat and can consist of the most varied kinds of material, above all non-textile material, e.g. metal, such as a steel or aluminium sheet, or an endless ribon of stainless steel, plastic or paper, preferably pure non-lacquered cellulose parchment paper which can optionally be coated with a film of vinyl resin, ethyl cellulose polyurethane resin or teflon.

If necessary the printing inks used according to the invention also contain in addition to the electroneutral deprotonised cationic dyes and indicator dyes defined herein at least one binder that is stable below 230° C. and acts as thickener for the printing batch and as at least temporary binder of the dye on the carrier to be printed. Synthetic, semisynthetic, and natural resins, i.e. both polymerisation and polycondensation and polyaddition products, are suitable as such binders. In principle, it is possible to use all resins and binders customarily used in the printing ink and paint industry. The binders should not melt at the transfer temperature, react chemically in the air or with themselves (e.g. cross-link), have little or no affinity fo the electroneutral, deprotonised cationic dyes used, solely maintain these at the printed area of the inert carrier without modifying them, and remain on the carrier in their entirety after the heat transfer process. Preferred binders are those that are soluble in organic solvents and that dry rapidly for example in a warm current of air and form a fine film on the carrier. Suitable water-soluble binders are: alginate, tragacanth, carubin (from locust bean gum), dextrin, more or less etherified or esterified mucilages, hydroxyethyl cellulose or carboxymethyl cellulose, water-soluble polyacrylic amides or, above all, polyvinyl alcohol: and suitable binders that are soluble in organic solvents are cellulose esters, such as nitrocellulose, cellulose acetate or butyrate, and, in particular, cellulose ethers, such as methyl, ethyl, propyl, isopropyl, benzyl, hydroxypropyl, or cyanoethyl cellulose, and also mixtures thereof.

When using dispersions, the electroneutral deprotonised cationic dyes dispersed in the printing ink must have principally a particle size of $\leqq 10\mu$, preferably $\leqq 2\mu$.

Besides water, practically all water-miscible and water-immiscible organic solvents or solvent mixtures are suitable which boil at atmospheric pressure at temperatures below 220° C., preferably below 150° C., and which have sufficient solubility or emulsifiability (dispersibility) for the electroneutral, deprotonised cationic dyes and the binders used. The following may be cited as examples of suitable organic solvents: aliphatic and aromatic hydrocarbons, e.g. n-heptane, cyclohexane, petroleum ether, benzene, xylene or toluene, halogenated hydrocarbons, e.g. methylene chloride, trichloroethylene, perchloroethylene or chlorobenzene, nitrated aliphatic hydrocarbons, e.g. nitropropane, aliphatic amides, e.g. dimethyl formamide or mixtures thereof, also glycols, e.g. ethylene glycol or ethylene glycol monoalkyl ethers, e.g. ethylene glycol monoethyl ether, diethyl carbonate, dimethyl carbonate, or esters of aliphatic monocarboxylic acids, e.g. ethyl acetate, propyl acetate, butyl acetate, β-ethoxyethyl acetate, aliphatic or cycloaliphatic ketones, for example methyl ethyl ketone, methyl isobutyl ketone, cyclohexanone, isophoron, mesityl oxide, or diacetone alcohol and alcohols, e.g. methanol, ethanol, and, preferably, n-propanol, isopropanol, n-butanol, tert. butanol, sec. butanol, or benzyl alcohol; also suitable are mixtures of the cited solvents, e.g. a mixture of methyl ethyl ketone and ethanol in the ratio 1:1.

Particularly preferred solvents are esters, ketones, or alcohols which boil below 120° C., e.g. butyl acetate, acetone, methyl ethyl ketone, ethanol, isopropanol or butanol. Virtually anhydrous printing inks are used with advantage.

The desired viscosity of the printing inks can be adjusted by addition of the cited binders, or by dilution with water or a suitable solvent.

The liquid, pasty or dry dyeing preparations contains as a rule 0.01 to 80, advantageously 1 to 30, percent by weight of at least one or more electroneutral, deprotonised cationic dyes, 0.1 to 10 percent by weight of one or more indicator dyes and optionally 0.5 to 50 percent by weight of a binder, based on the total weight of the preparation, and they can be used direct or after dilution as printing inks according to the invention.

The suitability of the printing inks can be improved by adding optional components, for example plasticisers, swelling agents, high boiling solvents such as e.g. tetralin or decalin, iogenic or non-ionogenic surface active compounds, for example the condensation product of 1 mol of octylphenol with 8 to 10 mols of ethylene oxide.

The dyeings preparations and printing inks (solutions, dispersions, emulsions) used according to the invention are manufactured by methods which are known per se by dissolving or dispersing the electroneutral, deprotonised cationic dyes together with the indicator dyes in water and/or a solvent or a solvent mixture, advantageously in the presence of a binder which is stable below 230° C.

The optionally filtered printing inks are applied to the inert carrier for example by spraying, coating, or advantageously by printing the carrier on parts of the surface or over the entire surface. It is also possible to apply a multicoloured pattern or to print successively in a base shade and subsequently with similar or different patterns.

After the printing inks have been applied to the inert carrier, these are then dried, e.g. with the aid of a flow of warm air or by infrared irradiation, optionally with recovery of the solvent employed.

The carriers can also be printed on both sides, whereby it is possible to select dissimilar colours and/or patterns for both sides. In order to avoid using a printing machine, the printing inks can be sprayed onto the auxiliary carrier, for example by using a spray gun. Particularly interesting effects are obtained if more than one shade is printed or sprayed onto the auxiliary carrier simultaneously. Furthermore, specific patterns can be obtained for example by using stencils or artistic patterns by using a brush. If the auxiliary carriers are printed, the most diverse printing methods can be employed, for example relief printing (e.g. letter-press printing, flexographic printing), intaglio printing (e.g. roller printing), silk-screen printing (e.g. rotary screen printing, flat-screen printing) or electrostatic printing.

The transfer is performed in the conventional manner by the action of heat. The treated carriers are brought into contact with the textile materials and kept at 120° C. to 210° C. until the electroneutral deprotonised cationic dyes applied to the carrier are transferred to the textile material. As a rule 5 to 60 seconds suffice for this.

The heat can be applied in various known ways, e.g. by passage through a hot heater drum, a tunnel-shaped heating zone or by means of a heated cylinder, advantageously in the presence of an unheated or heated backing roll which exerts pressure or of a hot calender, or also by means of a heated plate (iron or warm press), the various devices being preheated by steam, oil, infrared irradiation or microwaves to the required temperature, optionally under vacuum, or being located in a preheated heating chamber.

Upon completion of the heat treatment the printed goods are removed from the carrier. The printed material requires no aftertreatment, neither a steam treatment to fix the dyestuff nor washing to improve the fastness properties.

Compared with known processes, the process according to the invention has notable advantages. It has in particular the principal advantage of the now largely solved problem of achieving stong, brilliant dyeings and prints which are fast to wet treatments and light and of powerful whitentening effects on polyacrylonitrile fibres while maintaining optimum mechanical fibre properties. Compared with the prints obtained in known manner with cationic dyes, those obtained by the novel process are characterised by sharp, finely etched contours. They are more brilliant and faster, especially faster to sublimation, than those obtained with disperse dyes.

The following Examples illustrate the invention but do not limit it to what is described therein. The parts and percentages are by weight.

EXAMPLE 1

(a) The following ingredients are ground, with cooling, for 2 hours in a ball mill and simultaneously homogenised: 5 parts of the dye of the formula

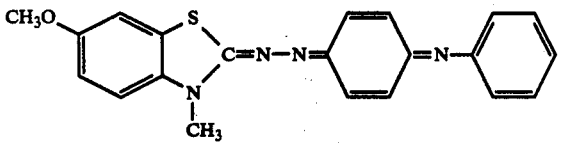

0.2 part of the indicator dye of the formula

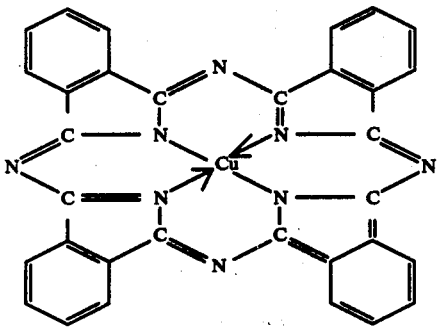

6.5 parts of ethyl cellulose and 88.3 parts of ethanol. After removal of the grinding elements a ready for use printing ink is obtained.

(b) The above blue printing ink is applied to the entire surface of a smooth parchment paper by printing and subsequently dried. A carrier paper suitable for the transfer printing process is obtained in this way.

(c) A polyacrylonitrile fabric (ORLON) is laid on the pretreated carrier and brought into contact with the treated side of the carrier, after which carrier and fabric are heated for 30 seconds to 195° C. using a heating plate. A second, insulated plate which is not heated ensures uniform contact. The dyed fabric is then separated from the carrier.

A polyacrylonitrile fabric which is dyed a strong blue shade of excellent wet and light fastness is obtained.

EXAMPLES 2 to 15

Column 3 of the Table indicates the shades of the strong dyeing and prints, or where appropriate, the fluorescent brightening effects, which are fast to light and wet treatment and are also obtained on polyacrylonitrile fibres (ACRYLAN ®, regular type 36), modacryl fibres (ORLON ®, type 44, ZEFRAN ®, type 100) or on fibre blends of polyacrylonitrile/wool, by using instead of the dye of Example 1 corresponding amounts of one of the dyes or fluorescent brighteners listed in column 2 and otherwise carrying out the procedure as in Example 1 b) and 1 c) with the printing inks obtained according to 1 a) to which an indicator dye corresponding to the shade after the development has been added.

TABLE

| 1<br>Example | 2<br>Dye or fluorescent Brightener | 3<br>Shade on polyacrylonitrile |
|---|---|---|
| 2 | 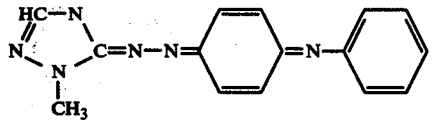 | purplish red |
| 3 | 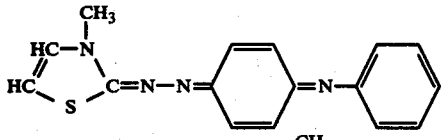 | violet |
| 4 | 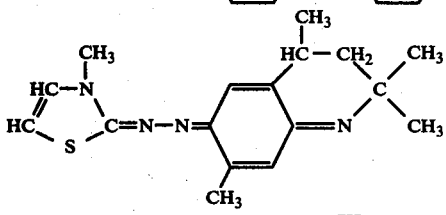 | violet |
| 5 | 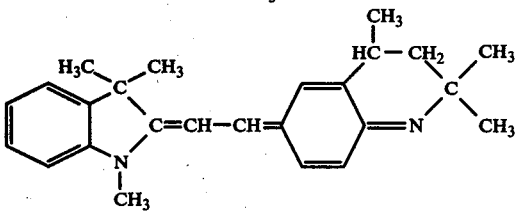 | violet |
| 6 | 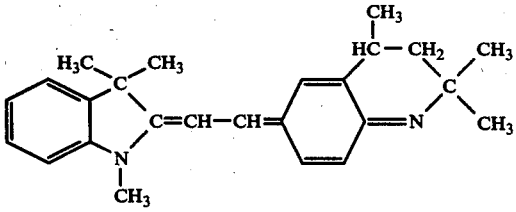 | blue |

TABLE-continued
| 1<br>Example | 2<br>Dye or fluorescent Brightener | 3<br>Shade on polyacrylonitrile |
|---|---|---|
| 7 | 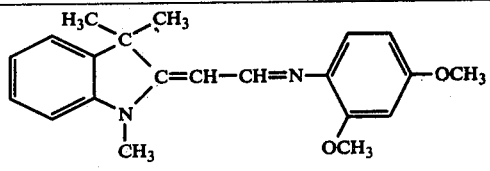 | yellow |
| 8 | 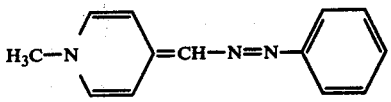 | yellow |
| 9 | 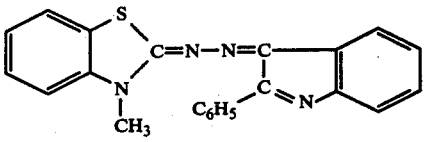 | red |
| 10 | 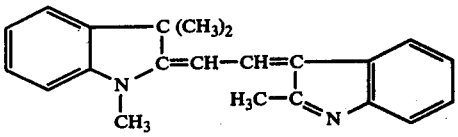 | orange |
| 11 | 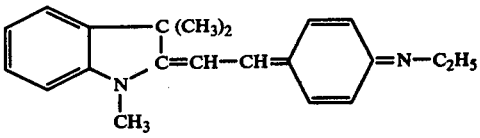 | pink |
| 12 | 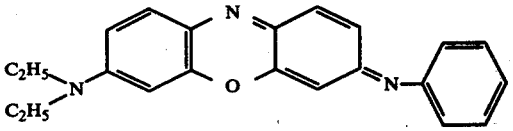 | blue |
| 13 | 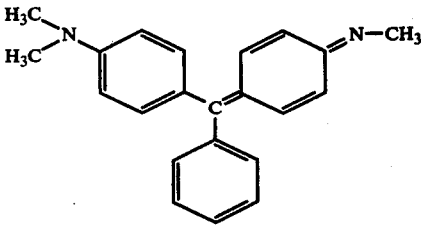 | green |
| 14 | 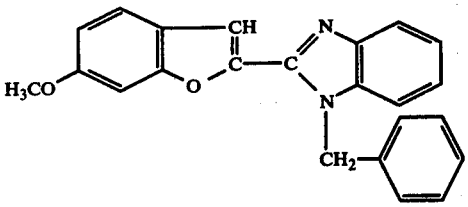 | brightener |
| 15 | 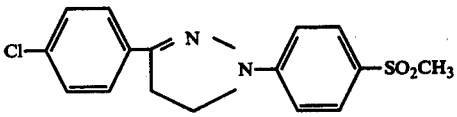 | brightened |
EXAMPLE 6
Manufacture of a deprotonised dye
At room temperature, 30 ml of 30% sodium hydroxide solution are added to the aqueous solution of 32.3 parts of the compound of the formula
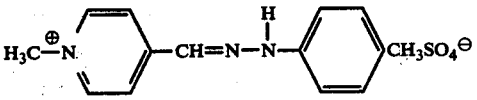

in 400 ml of water and the deprotonised dye of the formula

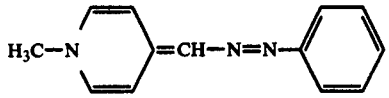

falls out in fine, dark violet crystals. After 30 minutes, the product is filtered with suction, washed with the filtrate and dried in vacuo.

We claim:

1. In a dry heat transfer process for the dyeing, printing or optical brightening of organic material susceptible to dyeing with cationic dyes which comprises (1) bringing the surface of the said organic material to be dyed, printed or optically brightened into contact with the treated surface of an inert carrier, said surface being treated with a printing ink containing at least one finely divided, electroneutral, deprotenized cationic dye or fluorescent brightener of the formula

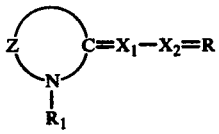

wherein R is an aromatic, heterocyclic or aliphatic radical which contains a deprotonized nitrogen atom (=N—), each of $X_1$ and $X_2$ independently is N, CH or $CR_2$, in which $R_2$ is alkyl of 1 to 4 carbon atoms, aryl or aralkyl, Z is a divalent radical which optionally contains further heteroatoms or fused rings and which completes the nitrogen-containing ring to form an unsaturated 5- or 6-membered ring, and $R_1$ is substituted or unsubstituted alkyl, and the deprotonized nitrogen atom in R is in conjugation to the

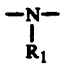

group, irrespective of the length of the conjugation system which advantageously extends over 3 to 17 members, (2) subjecting the said organic material and inert carrier while in contact to a heat treatment of 120° C. to 210° C., and (3) separating the said organic material from the said inert carrier, the improvement according to which the printing ink employed to treat the surface of the inert carrier additionally contains an indicator dye which does not exhibit acid reaction.

2. A process according to claim 1 wherein in the formula the group

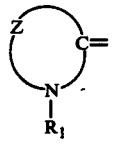

is a pyrazole, thiazole, triazole, benzthiazole, indazole, tetrahydroindole, pyridine or quinoline radical.

3. A process according to claim 1 wherein the indicator dye is present in an amount of 0.1 to 10 percent by weight based on the deprotonized dyes.

4. A process according to claim 3 wherein the indicator dye is present in an amount of from 0.5 to 1.5 percent by weight.

5. A process according to claim 1 wherein the indicator dye is present in the salt form of the protonized dyes corresponding to the deprotonized cationic dyes employed.

6. A process according to claim 1 wherein the indicator dyes present correspond to the shades which are obtained on the organic material after the transfer printing.

7. A process according to claim 1 wherein the organic material is polyacrylonitrile or modacryl fiber material which can be dyed with cationic dyes.

8. A process according to claim 1 which comprises subjecting carrier and organic material to be dyed to a heat treatment of 120° to 210° C. for 5 to 40 seconds under vacuum.

9. A dyeing preparation for use in the dry heat transfer process according to claim 1 which contains dissolved or dispersed in water, a solvent or mixtures thereof at least one electroneutral, deprotonized cationic dye, or fluorescent brightener and an indicator dye which does not exhibit acid reaction.

10. A carrier for use in the dry heat transfer process according to claim 1 which comprises an inert substrate treated with aqueous, organic-aqueous or organic printing inks which contain at least one electroneutral, deprotonized cationic dye or fluorescent brightener, an indicator dye which does not exhibit acid reaction and optionally a binder which is stable below 230° C.

11. A carrier according to claim 10 wherein the inert substrate is paper, aluminum foil or steel foil.

12. A carrier according to claim 10 wherein the printing inks contain a cellulose ether or ester and/or polyvinyl alcohol as binder.

* * * * *

UNITED STATES PATENT AND TRADEMARK OFFICE

CERTIFICATE OF CORRECTION

PATENT NO. : 4,137,042

DATED : January 30, 1979

INVENTOR(S) : RAYMOND DEFAGO, STEFAN KOLLER and PETER MOSER

It is certified that error appears in the above-identified patent and that said Letters Patent are hereby corrected as shown below:

In the heading of the patent, change "[45] Jan. 30, 1979" to read --[45]* Jan. 30, 1979--.

Further in the heading of the patent, immediately below "[73] Assignee:" insert the following --[*] Notice: The portion of the term of this patent subsequent to November 30, 1994, has been disclaimed.--

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*